United States Patent [19]

Gauer

[11] 4,089,476

[45] May 16, 1978

[54] TUBE MILL

[75] Inventor: Peter Gauer, Düsseldorf, Germany

[73] Assignee: Loesche Hartzerkleinerungs-und Zementmaschinen GmbH & Co. KG, Düsseldorf, Germany

[21] Appl. No.: 761,662

[22] Filed: Jan. 24, 1977

Related U.S. Application Data

[63] Continuation of Ser. No. 674,969, Apr. 8, 1976, abandoned.

[30] Foreign Application Priority Data

Apr. 18, 1975 Germany ..... 7512389[U]

[51] Int. Cl.[2] ..... B02C 23/16

[52] U.S. Cl. ..... 241/70

[58] Field of Search ..... 241/70, 71, 72, 79.2, 241/79.3

[56] References Cited

U.S. PATENT DOCUMENTS

| | | | |
|---|---|---|---|
| 1,058,953 | 4/1913 | Easton | 241/70 |
| 1,368,739 | 2/1921 | Lindhard | 241/70 |
| 1,606,545 | 11/1926 | Van Saun | 241/72 |
| 2,344,162 | 3/1944 | Miller | 241/70 |
| 2,398,989 | 4/1946 | Agthe | 241/70 |
| 2,950,869 | 8/1960 | Wales | 241/70 |
| 3,078,049 | 2/1963 | Hardinge | 241/70 |
| 3,078,050 | 2/1963 | Hardinge | 241/70 |
| 3,231,203 | 1/1966 | Hardinge et al. | 241/70 |

*Primary Examiner*—Granville Y. Custer, Jr.
*Attorney, Agent, or Firm*—Holman & Stern

[57] ABSTRACT

The specification describes a tube mill for the comminution of refuse and other waste materials, consisting of a rotary tube body with an axially arranged material inlet and material outlet in the case of which the tube body is partly filled with grinding bodies. The diameter of the tube mill is two to three and a half times greater than the length of the tube mill with respect to that part of the tube mill, which has a cylindrical tube form, and furthermore the clearance diameter of the inlet opening amounts to at least 25% of the clearance mill housing diameter. Furthermore, the outlet duct is provided at the inner walls with helically arranged baffle surfaces.

7 Claims, 3 Drawing Figures

TUBE MILL

This is a continuation of application Ser. No. 674,969, filed Apr. 8, 1976.

BACKGROUND OF INVENTION

1. Field to Which Invention Relates

The invention relates to a tube mill for the comminution of refuse and other waste materials, consisting of a rotary tube body with an axially arranged material inlet and material outlet in the case of which the tube body is partly filled with grinding bodies.

2. The Prior Art

Methods for disposing of refuse have been developed and put into practice. These methods take as their aim the burning of refuse substances as they are produced or depositing them, sorting them or making them into compost.

SUMMARY OF INVENTION

The present invention is not directly concerned with the disposal of refuse but with its preparation so as to bring it into a state which very much facilitates disposal by burning, stacking and composting. Previously proposed devices for preparing refuse have involved comminuting the refuse as produced in hammer mills, impact mills, cutting mills, cutting shears, shredders or similar devices. In this respect the question of economy in power and reduction in wear in the equipment was often not satisfactorily solved.

One aim of the present invention is that of further developing previously proposed tube or tubular mills which were previously used for different purposes so that while bringing about a maximum reduction in material wear they are capable of comminuting mixtures of refuse and other waste materials and segregating certain parts of metal from the refuse so that while ensuring a minimum requirement as regards material and power the greatest possible grinding or comminuting efficiency is ensured.

The invention resides in that the diameter of the tube mill is two to three and a half times greater than the length of the tube mill with respect to that part of the tube mill, which has a cylindrical tube form, and furthermore the clearance diameter of the inlet opening amounts to a least 25% of the clearance mill housing diameter, and furthermore the outlet duct is provided at the inner walls with helically arranged baffle surfaces.

In the case of one particular embodiment of the invention the conical end walls of the mill housing have a slope between 7.5° and 16° with respect to the vertical. In the case of another embodiment the outlet sieve wall is provided with oval passage openings, preferably lying perpendicularly with respect to the peripheral direction and whose passage area amounts in all to more than 50% of the total area of the sieve plates. In accordance with the invention the outlet sieve plates and the remaining armor plates are attached by gripping rails.

In the case of a further embodiment behind the outlet sieve wall lifting vanes are arranged, which form an angle with the imaginary radial plane of the tube mill and whose end adjacent to the center of the mill is bent down towards the radial surfaces. In accordance with the invention the outlet end wall and the outlet sieve wall and the lifting vanes form channels, which broaden out in an axial direction towards the center of the mill. In front of the outlet channel a draw-off hood or, respectively, a conically shaped sheet metal body is arranged, through which an air current, produced by a blower arranged outside the tube mill, is produced through the tube mill in a direction of the flow of material to be ground. Adjacent to the surface of the material to be ground at a degree of filling of approximately 30% of the tube mill slots are arranged in the peripheral direction, through which for example tin cans after being battered flat and the like can be removed. In accordance with the invention at the end of the outlet channel a draw-off hood can be arranged having sieve openings in the wall of the hood so that it is possible to separate the material removed into at least two fractions.

In accordance with the invention furthermore at the edge of the inlet opening an annular bead is provided, which prevents movement of the material to be ground into the inlet. In accordance with the invention, finally, in front of the inlet opening of the suction hood a chute with side walls is arranged, which is arranged over a shaft, extending to the rear, in a rotary bearing, while on the rear side of the chute a counter-weight with an arm is provided, which holds the chute in the position indicated in order to guide the material to be comminuted into the draw-off hood.

The conception of the tube mill in accordance with the invention is based on the results of series of tests, which were carried out for refuse mixtures with very different compositions. It was found that in the case of the tube mill in accordance with the invention practically every type of refuse mixture produced could be satisfactorily comminuted, with little wear, and could be mixed. This comprised in particular the removal of metal cans after they had been battered flat and the subsequent sorting of the material into at least two fractions.

In many case refuse comprises lumps with a higher specific gravity, of which the individual pieces act like grinding bodies contributing to the comminution of the material. If the proportion of lump material is not sufficient in order to obtain satisfactory comminution efficiency, the deficient part of lumps can be made up by a corresponding quantity of grinding bodies, more particularly grinding balls of suitable size and weight. In many cases it may also be advantageous to use grinding bodies with a different size and a different weight. This measure is easy to put into practice in the case of grinding balls with different diameters.

LIST OF SEVERAL VIEWS OF DRAWINGS

In the drawing an embodiment of the invention is represented.

DESCRIPTION OF PREFERRED EMBODIMENTS

Figure 1:
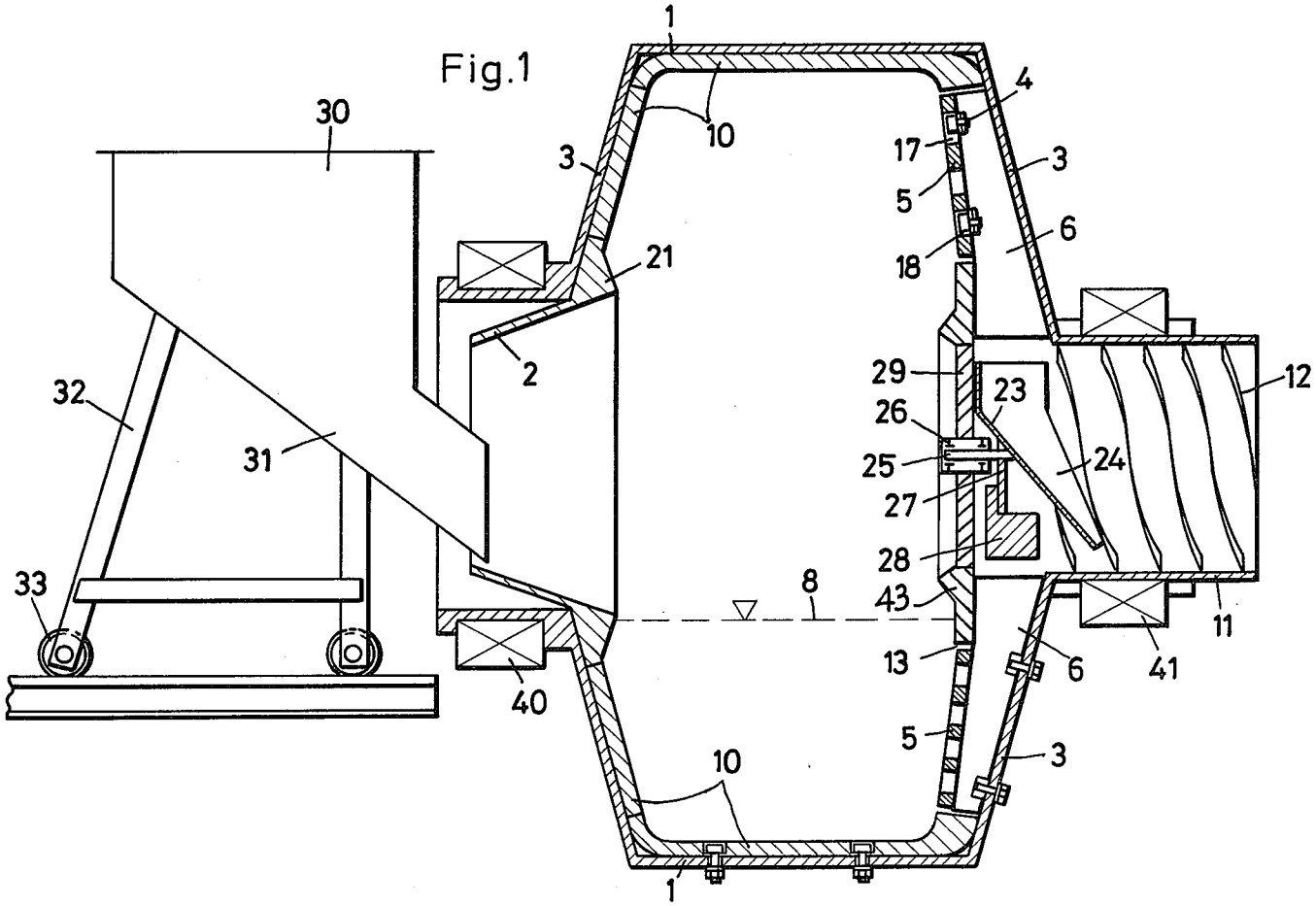
FIG. 1 shows a sectional view of a tube mill in the case of which the sections are so arranged through the outlet sieve wall that in the upper part of the section the bolts with the gripping rails are visible while in the lower part they are not visible.

The tube mill represented in FIG. 1 has a housing 1, the central portion of the housing 1 being cylindrically constructed the end walls 3 of the housing being inclined in an outward direction on opposite sides thereof, the end walls each having a slope between 7.5° and 16° with respect to the vertical. Reference numeral 2 indicates the inlet opening for annular refuse material. At the rear conical side wall 3 the outlet sieve plates 5 are attached by means of bolts or studs 4 cooperating with gripping rails 18 which are connected by the bolts 4 to lifting vanes 6. On the rear side between the conical end wall 3 and the outlet plates 5 sheet metal baffles form the lifting vanes 6 and are arranged, to guide the comminuted material to outlet hood 11. In FIG. 1 furthermore a chute 23 is indicated diagrammatically in section, which has side walls 24. On the rear side of the chute a trunnion 25 is arranged, which is guided in a bearing 26. Furthermore, an arm 27 is provided, which at its front end carries a counter-weight 28. The bearing 26 is attached to a disc 29, the disc 29 being mounted within the central portion of an annular plate 43, the plate 43 being received within the central portion of the innermost annular outlet sieve plate 5, the disc 29, the plate 5 and the plate 43 being concentrically arranged and mounted together and to the inner walls of the housing 1. The counterweight 28 has the purpose of holding the chute generally in that position, which is represented in FIG. 1. This means that during the rotation of the tube mill it is only the chute which substantially retains the same position in order to be able to catch the ground material, which is passed to it by the lifting vanes 6 from above. As will be readily gathered in this manner the ground material passes into the drawoff hood 11 and is removed by the rotation of the tube mill by means of guide vane 12.

Reference numeral 10 indicates the armor in the cylindrical part of the tube mill and behind the front conical end wall 3.

As a matter of general practice the mill is filled for approximately 30% of its volume with material to be ground. Reference numeral 8 denotes in FIG. 1 the upper edge of the material to be ground. The mounting between the plate 43 and the sieve plates 5 is such as to provide spaces 13 between the plate 43 and the innermost sieve plate 5 for the purpose of allowing the passage, below the level line 8, of tin cans or the like which have been battered flat and which are then entrained by the lifting vanes.

At the inner end of the inlet 2 an annular bead 21 is provided, which is to prevent movement of the material and the grinding bodies, not shown for convenience of illustration, out of the interior of the tube mill into the inlet opening and also serves to deflect the grinding bodies.

The supply of the material is via an inlet opening 30 and the chute 31 which is mounted on a frame 32 with ground engaging wheels 33.

Figure 2:
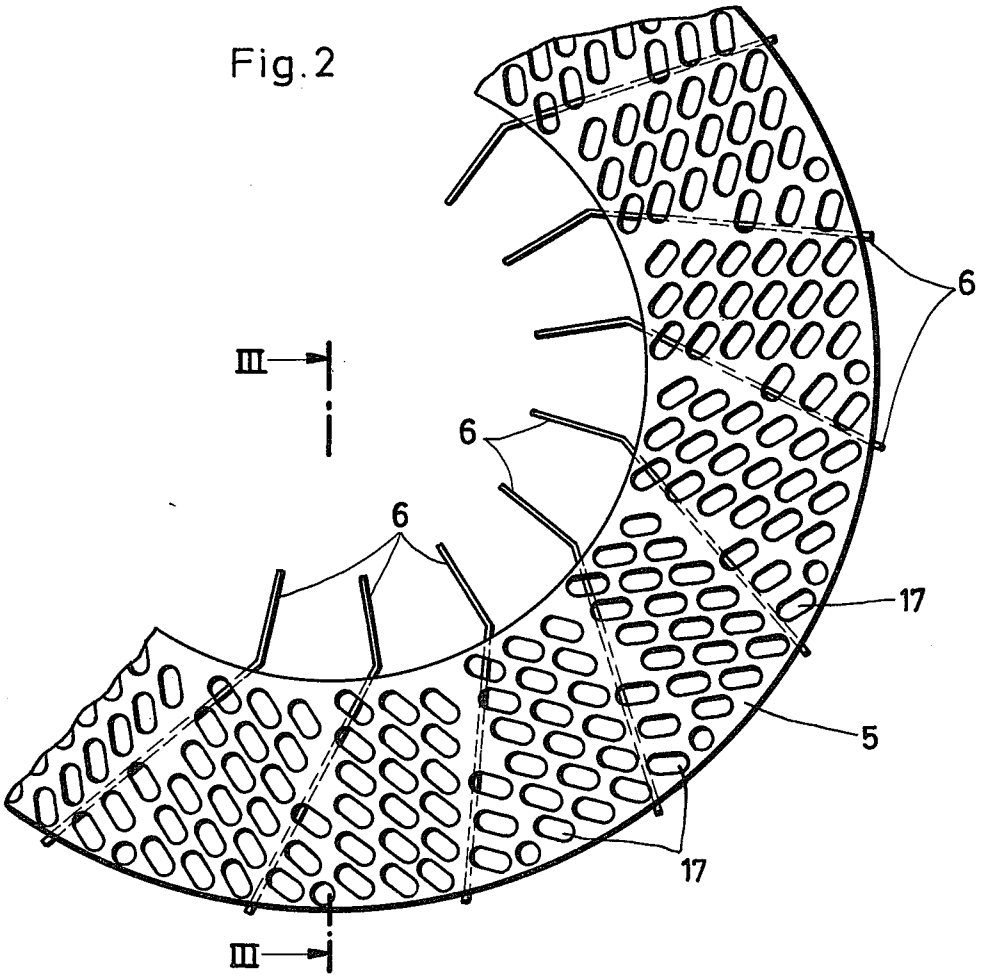
FIG. 2 shows a part view of an end wall with a representation of the outlet sieve plates.

FIG. 2 shows a part view of the outlet sieve wall 5 with oval passage openings 17 whose passage area in all amounts to more than 50% of the total area of the sieve plates. Tests have shown that owing to the oblique arrangement of the openings the output of the tube mill can be substantially increased. Furthermore, the representation shows the arrangement of the lifting vanes 6. It will be clearly seen that the distance between the lifting vanes decreases towards the axis of the mill and that the lifting vanes themselves are bent or curved at their inner ends.

Figure 3:
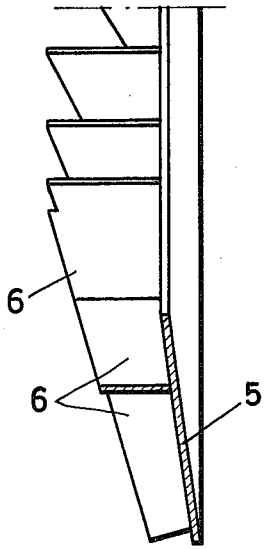
FIG. 3 shows a section in accordance with the section line III—III in FIG. 2.

FIGS. 3 shows a part section on the section line III—III in FIG. 2, which shows the arrangement and construction of the lifting vanes 6.

It follows as a matter of course that for comminuting operation the whole tube mill body is turned with the exception of the chute 23, 24 and the associated parts. The bearing arrangement for the tube mill can be with bearings 40, 41 of conventional construction, whose form does not form part of the invention.

It has been found that it is advantage to select an operational speed of rotation lying between 65 and 78% of the critical speed of rotation.

I claim:

1. In a tube mill for comminution of refuse and other waste materials, grinding members being disposed within the tube mill for contact with the refuse, the tube mill having an inlet opening for receiving the refuse thereinto and an outlet opening for discharge of the comminuted material, the tube mill being formed of a tubular housing having a cylindrical central portion and outwardly diverging frusto-conical portions, the improvement comprising:

an annular outlet sieve wall mounted for rotation in the housing and having oval passage openings formed therein, the major axes of the oval passage openings being disposed at an angle to radii extending from the axis of rotation of the sieve wall, and lifting blades mounted to the sieve wall, the blades having inner portions which extend radially from the axis of rotation of the sieve wall, outer portions of the blades being disposed at angles to the inner portions of the blades.

2. The tube mill of claim 1 wherein the diameter of the cylindrical portion of the tubular body is two to three and one-half times larger than the length along the longitudinal axis of the housing of the cylindrical portion thereof.

3. The tube mill of claim 1 and further comprising outlet means mounted to the housing and communicating with the outlet opening; and, helical guide means disposed within the outlet means.

4. The tube mill of claim 1 wherein an opening formed adjacent the inner periphery of the sieve wall is provided through which pieces of flattened metal can be removed.

5. The tube mill of claim 1 and further comprising:

chute means disposed in the outlet opening;

rotary bearing means for mounting said chute means; and counterweight means for maintaining the chute means on the bearing means in a vertical orientation without rotation therewith, thereby allowing the chute means to continuously receive the comminuted material thereinto.

6. The tube mill of claim 1 wherein the walls of the end portions of the tubular housing are inclined between 7.5° and 16° relative to the vertical.

7. The tube mill of claim 1 wherein the oval passage openings comprise at least 50% of the surface area of the sieve wall.

* * * * *